US005635661A

United States Patent [19]

Tuftee

[11] Patent Number: 5,635,661

[45] Date of Patent: Jun. 3, 1997

[54] CARTRIDGE CASE REFORMING DIE

[76] Inventor: Edward M. Tuftee, 11625-198th Ave., SE., Issaquah, Wash. 98027-8521

[21] Appl. No.: 615,707

[22] Filed: Mar. 13, 1996

Related U.S. Application Data

[63] Continuation-in-part of Ser. No. 921,858, Jul. 29, 1992, abandoned.

[51] Int. Cl.[6] ..... F42B 33/00; F42B 33/02

[52] U.S. Cl. ..... 86/24; 86/37

[58] Field of Search ..... 86/24, 37

[56] References Cited

U.S. PATENT DOCUMENTS

| | | | |
|---|---|---|---|
| 3,440,923 | 4/1969 | Purdie | 86/43 |
| 3,555,641 | 1/1971 | Lee | 29/1.32 |
| 3,705,515 | 12/1972 | Lee | 72/367 |
| 4,189,980 | 2/1980 | Schaenzer | 86/24 |
| 4,325,282 | 4/1982 | Schaenzer | 86/24 |
| 4,593,598 | 6/1986 | Gunder | 86/36 |
| 4,637,291 | 1/1987 | Alexander | 86/23 |
| 4,723,472 | 2/1988 | Lee | 86/24 |
| 4,836,078 | 6/1989 | Lee | 86/24 |
| 4,984,501 | 1/1991 | Roller | 86/36 |
| 5,221,806 | 6/1993 | Chaney et al. | 86/19 |

*Primary Examiner*—J. Woodrow Eldred
*Attorney, Agent, or Firm*—Klarquist Sparkman Campbell Leigh & Whinston, LLP

[57] ABSTRACT

An ammunition cartridge case reforming die to be used in reloading operations having a central bore defining the external configuration to which the outer surface of the cartridge case is to be reformed. A mandrel having an outer surface of a configuration to which the inner diameter of the cartridge case neck is to be formed is mounted co-axially in the bore. A stop element adjacent the mandrel has a stop surface which extends radially outwardly from the mandrel toward the bore inner wall. The stop surface is positioned and angled such that it will limit the lengthwise growth of the case neck during resizing and also produce a chamfer on the inner mouth surface of the case neck.

24 Claims, 2 Drawing Sheets

CARTRIDGE CASE REFORMING DIE

This is a continuation-in-part of patent application U.S. Ser. No. 07/921,858, filed Jul. 29, 1992, abandoned.

FIELD OF THE INVENTION

This invention relates to apparatus used in reloading firearm cartridges, and more specifically to a die that provides proper forming of the cartridge case while chamfering the mouth of the case and restricting case length growth.

BACKGROUND OF THE INVENTION

The process for reloading cartridges is most frequently practiced by hobbyists who wish to tailor-make their ammunition, or the frequent shooter who wants to save money by reloading his own cartridges. The reloading equipment (e.g. for reloading rifle cartridges) includes a press that is typically adapted to be mounted to a workbench. The press includes a die holder, a cartridge case holder, and mechanism for producing relative movement of the die holder and cartridge case holder toward and away from each other.

When a round of ammunition is fired the cartridge case may be enlarged, and prior to reloading it needs to be properly resized. For this purposes a resizing die is mounted in the reloading press and the cartridge case is pressed axially into the internal bore of the resizing die to compress and reform the sides of the cartridge case into the appropriate cross-sectional configuration. Often this resizing operation also will include the use of an elongate rod which extends axially through the resizing die and has a pin at its lower end to push a spent primer from the primer pocket in the head of the cartridge case.

In the past during such resizing operations, as the cartridge case is resized, by being pressed inwardly, it has had a tendency to elongate, or grow, such that eventually trimming of the cartridge case length is required. Further, additional steps usually are required to cut a chamfer on the inner mouth, or rim, portion of the neck of the cartridge case to aid in reception of a bullet.

SUMMARY OF THE INVENTION

The present invention provides a reloading die for sizing an ammunition case which has a stop element mounted in the resizing bore with a stop surface positioned at a selected axial position in the bore of the die to limit the length of the cartridge case during resizing and restrict case length growth.

Further, the present invention provides a stop surface in the resizing die which is disposed at an angle relative to the longitudinal axis of the resizing die to produce a chamfer on the inner surface of the mouth of the cartridge case during the resizing operation.

The present invention provides a novel and economical resizing device which inhibits the lengthwise growth of the neck of the cartridge case during the resizing operation and produces a chamfer therein, thus to eliminate the need for subsequent length trimming and separate chamfering steps. Further this allows the cartridge case to retain its weight and neck thickness, which in the past has been reduced due to the elongation and trimming processes of prior reloading operations.

In addition the present invention prevents inward or outward buckling of a cartridge case neck as the case mouth abuts an angled stop surface in the die to produce a chamfer in the case couth and control case length growth.

The invention will be more fully understood and appreciated by reference to the following description and drawings referred to therein.

DETAILED DESCRIPTION OF PREFERRED EMBODIMENTS OF THE INVENTION

Figure 1:
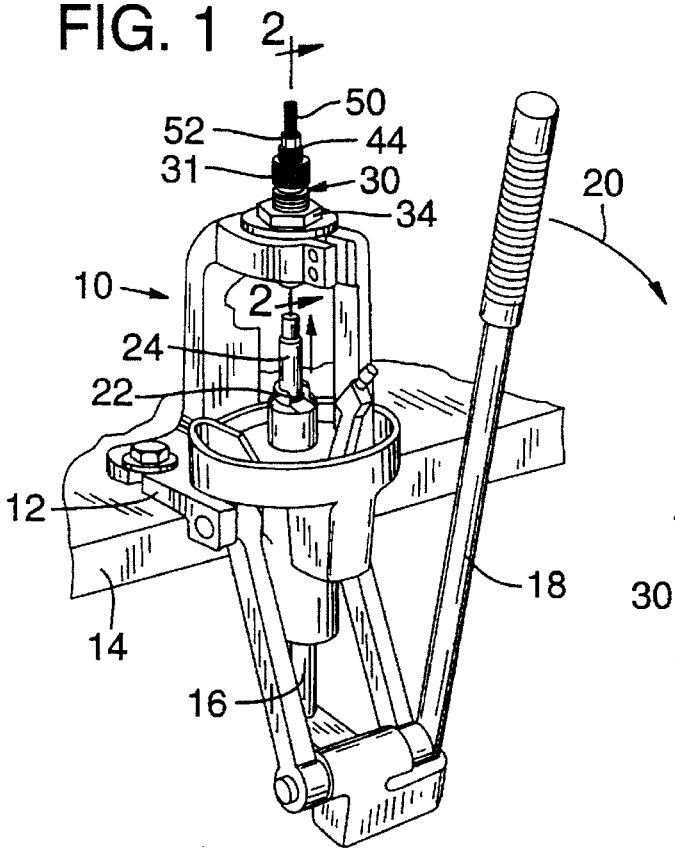
FIG. 1 is a perspective view of reloading apparatus which utilizes the resizing die of the present invention.

Referring to the drawings, and first more specifically to FIG. 1, at 10 is illustrated generally reloading apparatus, or press, of known design. The apparatus includes a base 12 having a bracket through which it may be securely mounted to a workbench 14. The press includes a ram 16 actuated by lever 18. As the lever is swung in the direction of arrow 20 ram 16 moves upwardly and a cartridge case holder 22 mounted atop ram 16 and holding a cartridge case 24 is forced upwardly toward a resizing die 30 constructed according to an embodiment of the present invention mounted at the top of press 10 in line with upward movement of cartridge case 24.

The present invention is directed more specifically to the structure and operation of resizing die 30 as will be described below. In a preferred embodiment the resizing die is combined with a primer cap removing feature also.

Figure 2:
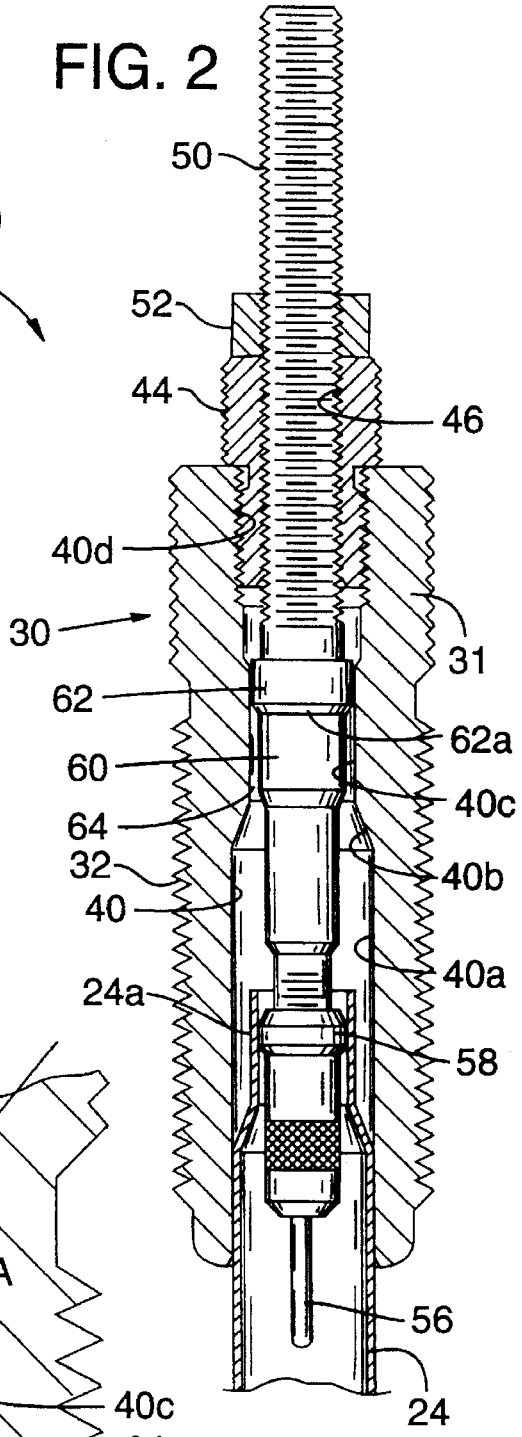
FIG. 2 is an enlarged cross-sectional view of a resizing die constructed according to an embodiment of the present invention taken along the line 2—2 in FIG. 1, with a cartridge case to be resized initially entering the lower end of the die.

Referring to FIG. 2, the resizing die 30 includes an elongate die body, or member, 31 having external threads 32 allowing it to be screwed into a threaded bore at the top of press 10. The die is locked into position in the die holder by a locking, or jam, nut 34.

The die body has a bore 40 extending axially therethrough. The lower portion **40*a* of the bore has a cylindrical inner wall surface with a cross-section configuration substantially conforming to the desired external configuration to which the main body portion of a cartridge case is to be formed. A sloping bore section 40*b* has an internal cross-section configuration substantially conforming to the desired external configuration to which the shoulder portion of a resized cartridge case is to formed. Bore section, or neck region, 40*c*, has an inner wall defining a cross-sectional internal configuration substantially conforming to the desired external configuration to which the neck of the cartridge case is to be sized. The upper portion 40*d* of the bore has a greater diameter than neck region 40*c*** and is internally threaded.

An adapter 44 has external threads at its lower end allowing it to be screwed into bore section **40*d*. Its upper portion is knurled allowing a user manually to screw it into and out of bore 40***d*. As is seen in FIG. 2, adapter 44 has an internally threaded through-bore 46 which is concentric with bore 40 when the adapter is screwed into place.

An elongate rod 50 having an externally threaded upper end section is screwed into adapter 44 and extends concentrically and co-axially into bore 40. The longitudinal, or axial, position of rod 50 in the bore may be selectively adjusted to multiple positions by screwing the rod up or down. A jam, or locking, nut 52 is screwed onto rod 50, and when the rod is in a selected position the nut is screwed tightly against adapter 44 to lock rod 50 in position.

The lower end of rod 50 also is externally threaded and has a de-capping pin 56 and expander ball 58 screwed thereon. These may be adjusted axially on rod 50 as desired for proper operation. Their use within the reloading apparatus will be described more fully below.

Mounted coaxially on rod 50, intermediate its threaded upper end and expander ball 58, are a mandrel 60 and a stop 62. In the illustrated embodiment the mandrel and stop are formed integrally with rod 50. They could, however, be formed independently and attached to the rod by known methods, such as by present taper fit, epoxy, welding, etc. As is seen in FIG. 2 the mandrel and stop elements are received co-axially in neck section 40*c* of the bore.

The mandrel has an outer surface with a diameter less than the diameter of bore section 40*c* and substantially equal to the desired internal diameter to which the neck of a cartridge case is to be sized. A neck-receiving space 64 thus is produced between the outer surface of mandrel 60 and bore section 40*c* of a width only slightly greater than the thickness of the neck material of cartridge case 24. A chamfered lead-in portion 61 is disposed at the lower end of mandrel 60 to guide the case neck smoothly onto the mandrel.

Stop 62 is secured adjacent, or at the top end, of mandrel 60. Stop 62 projects outwardly beyond the outer diameter of the mandrel toward the inner wall surface of section 40*c* of the bore. The diameter of the stop is closely similar to the internal diameter of bore region 40*c* to produce a sliding, but close fit therebetween.

Figure 4:
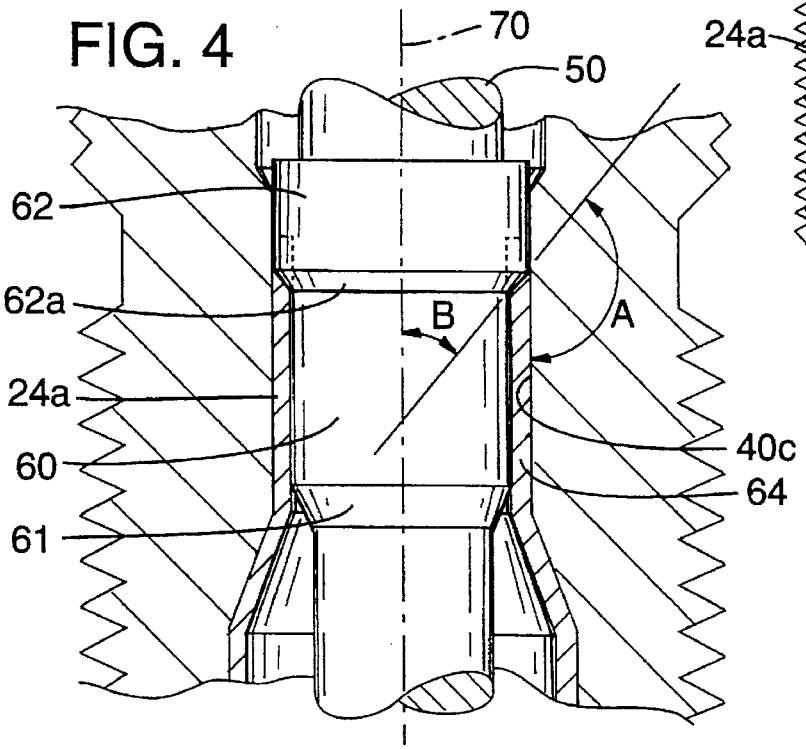
FIG. 4 is an enlarged view of a portion of the resizing die and the neck portion of a cartridge case therein.

The lower end of stop 62 defines a stop surface, or chamfer area, 62*a* facing space 64. Stop surface 62*a*, as best seen in FIG. 4, is formed as a ring which is disposed at an angle A is greater than 90° relative to the outer surface of mandrel 60. This angle may be in a range of from 120° to 170°, more preferably in a range of from 130° to 160°, and still more preferably about 135°. Correspondingly, as shown in FIG. 4 also, surface 62*a* is formed at an angle B relative to the longitudinal axis 70 of mandrel 60, rod 50, and bore 40 which is in a range from 10° to 60°, more preferably from 20° to 50°, and still more preferably about 45°. The selected angle is dependent on bullet shapes to be used with the cartridge case, the cartridge case material, and other factors.

Explaining operation of the embodiment thus far described, die 30 is mounted in press 10 as illustrated in FIG. 1. A cartridge case 24 to be resized is received and held in cartridge case holder 22. The combined mandrel and stop element (60, 62) is moved to a selected axially adjusted position in bore 40 by adjustment of threaded rod 50 in adapter 44. The stop surface is located in the bore at a position to which the length of the case neck is to be limited. When the mandrel and stop are positioned as desired in neck region 40*c* of the bore jam nut 52 is tightened to lock the rod 50 in the selected position. Decapping pin 56 and expander ball 58 are positioned axially as desired on the lower end of rod 50.

Lever 18 is swung downwardly in the direction of arrow 20, forcing ram 16 and cartridge case 24 upwardly with the cartridge case entering bore 40 as illustrated in FIG. 2. If the cartridge case body has been expanded upon firing the cross-sectional configuration of the main body portion of the cartridge case is resized as it is forced upwardly into bore section 40*a*. As the cartridge case moves upwardly into the die toward the position shown in FIG. 3, decapping pin 56 pushes a spent primer 72 from the primer pocket in the head of cartridge case 24.

Figure 3:
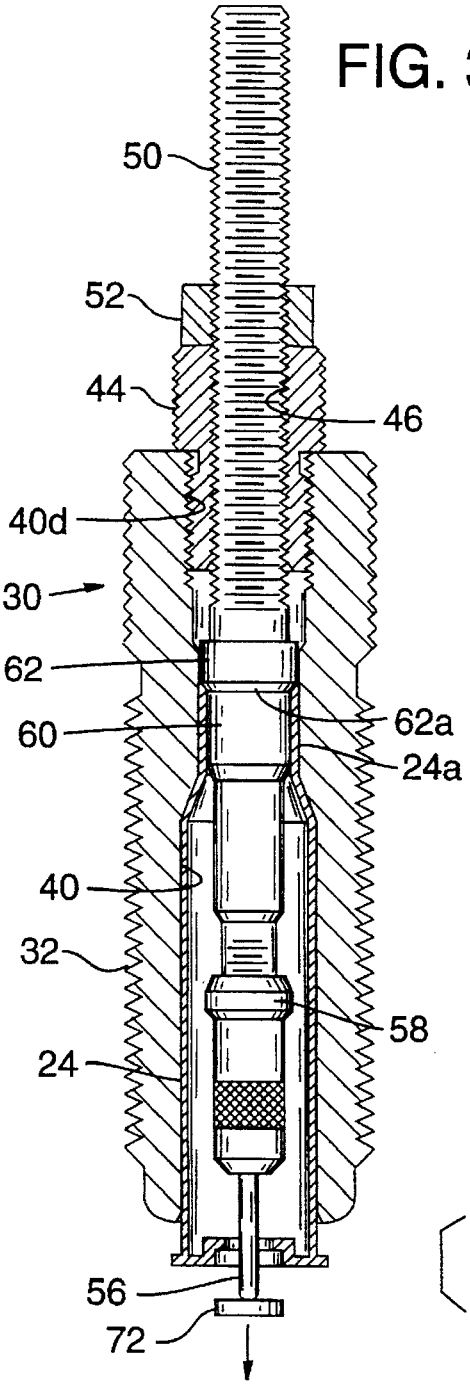
FIG. 3 is a view similar to FIG. 2, but with the cartridge case pressed fully into the resizing die.

As the neck 24*a* of the cartridge case is received in neck region 40*c* of the bore it enters space 64 between bore section 40*c* and mandrel 60. As it is forced upwardly into the space as illustrated in FIGS. 3 and 4 the case is properly resized to its desired cross-sectional configuration by the wall of bore section 40*c* and mandrel 60.

Stop 62 has been properly positioned in neck region 40*c* of bore 40, such that its stop surface 62*a* is positioned at a selected axial position in the bore to which the length of the neck is to be limited. The mouth, or outer end region of neck 24*a* is pressed firmly against stop surface 62*a* during the pressing operation. Due to stop surface 62 being firmly fixed it prevents the neck from elongating as it is re-sized. Further, the angled orientation of stop surface 62 produces a chamfer on the inner surface of the mouth of the cartridge case corresponding to the angle of the stop surface relative to the mandrel and longitudinal axis of the device.

In this portion of the resizing operation the inner and outer surfaces of the case neck are confined and properly formed to the desired cross-sectional configuration. The wall thickness is radially confined by the inside diameter of the neck region of the bore and the outside diameter of the mandrel as the case mouth abuts the chamfer stop surface to produce the selected chamfer on the inner side of the mouth of the cartridge case. The case length is restricted to a pre-desired length and the close fitting between the inside diameter of the neck region of the bore and the outer surface of the mandrel maintains concentric alignment of the neck of the cartridge case in its appropriate position.

Not only does this operation inhibit the elongation which has occurred in prior resizing operations following repeated resizing, but it has been found that this device can reverse the previously produced elongating flow of cartridge case material to eliminate subsequent trimming and chamfering. In such operation the cartridge case can retain its full weight and neck wall thickness.

As the press withdraws the cartridge case from the resizing die the neck of the case passes over expander ball 58 which will provide a slight expansion of the neck required to provide a proper internal diameter for the neck of the case to receive a bullet in a later reloading step.

Figure 5:
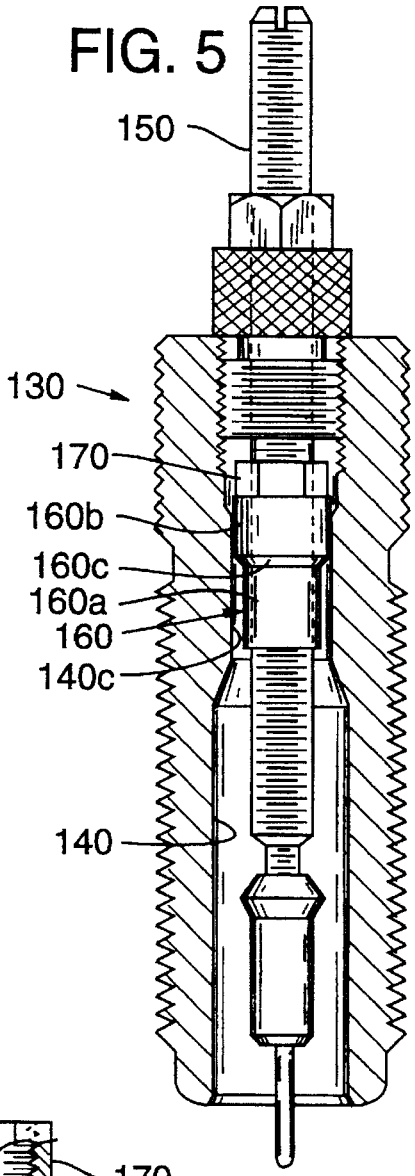
FIG. 5 is a cross-sectional view similar to FIG. 2, of an alternate embodiment of the invention.
Figure 6:
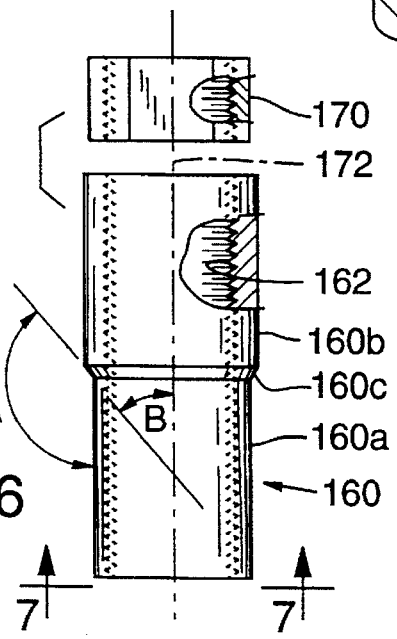
FIG. 6 is an enlarged side elevational view of a mandrel and stop member and a jam nut combination used in the embodiment illustrated in FIG. 5.
Figure 7:
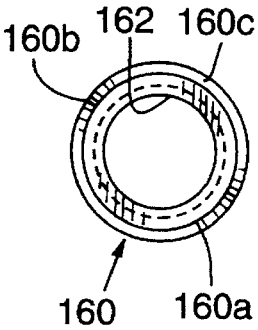
FIG. 7 is a view taken generally along the line 7—7 in FIG. 6.

FIGS. 5–7 illustrate an alternate embodiment 130 of the invention. For the most part the device 130 is somewhat similar to that previously described. However, in this embodiment rod 150 extending axially through bore 140 is threaded throughout substantially its full length. A combined mandrel and stop element, or member, 160 having a mandrel portion 160*a*, and a stop portion 160*b* has a bore 162 therethrough which is internally threaded, such that it may be screwed onto and adjusted axially on rod 150.

A jam, or locking, nut 170 also is screwed onto rod 150. When stop and mandrel member 160 is properly positioned on rod 150, nut 170 is screwed tightly thereagainst to secure it in position on rod 150.

Referring to FIGS. 6 and 7, it will be seen that the integral, or unitary, combination mandrel and stop member 160 has a mandrel portion 160*a* and a stop portion 160*b*. The mandrel portion has a cylindrical outer surface of a first diameter which is less than the internal diameter of the neck region 140*c* of the die with which it is to be used and substantially equal to the desired internal diameter to which the neck of a cartridge case is to be sized. The stop portion 160*b* has a second diameter greater than the first diameter and forms a stop surface 160*c* which projects radially and axially outwardly from the mandrel portion. Stop surface 160*c* is disposed at an angle A which is greater than 90° relative to the outer surface of mandrel portion 160*a*. This angle may be in a range of from 120° to 170°, more preferably in a range of from 130° to 160°, and still more preferably about 135°. Correspondingly, as shown in FIG. 6, surface 160*c* is formed at an angle B relative to the longitudinal axis 172 of the mandrel and stop element (also the axis of rod 150 and bore 140) which is in a range from 10° to 60°, more preferably from 20° to 50° and still more preferably about 45°.

The operation of the embodiment illustrated in FIGS. 5–7 is substantially similar to that previously described.

Although the embodiments illustrated are shown conformed to and working with shouldered cartridge cases, the invention is adapted for use with straight walled cases as well.

Other applications and embodiments of the invention may be recognized by those skilled in the art without departing from the scope of the invention. Accordingly, the invention is to be determined based on the scope of the appended claims and not to be limited by the above description of preferred embodiments.

What is claimed is:

1. A die for sizing an ammunition case wherein the case has an elongate body, a neck at one end of the body for receiving a bullet and a closed head at the opposite end of the body, the die comprising, an elongate member having an axial bore for receiving the neck of such case coaxially therein, said bore having an inner wall defining a cross-sectional internal configuration substantially conforming to the desired external configuration to which the neck of the case is to be sized, a mandrel mounted in the bore having an outer surface with a diameter less than the diameter of said bore and substantially equal to the desired internal diameter to which the neck is to be sized to define a neck-receiving space between the mandrel and wall, and a stop adjacent said mandrel and projecting outwardly beyond the outer diameter of said mandrel toward said wall, said stop having a stop surface facing said space positioned at a selected axial position in said bore to which the length of said neck is to be limited.

2. A die for sizing an ammunition case wherein the case has an elongate case body, a neck at one end of the case body for receiving a bullet and a closed head at the opposite end of the case body, the die comprising an elongate die body having an axial bore for receiving the neck of such case coaxially therein, said bore having an inner wall defining a cross-sectional internal configuration substantially conforming to the desired external configuration to which the neck of the case is to be sized, a mandrel mounted in the bore having an outer surface with a diameter less than the diameter of said bore and substantially equal to the desired internal diameter to which the neck is to be sized to define a neck-receiving space between the mandrel and wall, and a stop adjacent said mandrel and projecting outwardly beyond the outer diameter of said mandrel toward said wall, said stop having a stop surface facing said space positioned at a selected axial position in said bore to which the length of said neck is to be limited, wherein said stop surface forms a ring which projects outwardly beyond and is disposed at an at an angle greater than 90 degrees relative to the outer surface of the mandrel.

3. The die of claim 2, wherein said angle is in a range of from 120 to 170 degrees.

4. The die of claim 2, wherein said angle is in a range of from 130 to 160 degrees.

5. The die of claim 2, wherein said angle is about 135 degrees.

6. A die for sizing an ammunition case wherein the case has an elongate case body, a neck at one end of the case body for receiving a bullet and a closed head at the opposite end of the case body, the die comprising an elongate die body having an axial bore for receiving the neck of such case coaxially therein, said bore having an inner wall defining a cross-sectional internal configuration substantially conforming to the desired external configuration to which the neck of the case is to be sized, a mandrel mounted in the bore having an outer surface with a diameter less than the diameter of said bore and substantially equal to the desired internal diameter to which the neck is to be sized to define a neck-receiving space between the mandrel and wall, and a stop adjacent said mandrel and projecting outwardly beyond the outer diameter of said mandrel toward said wall, said stop having a stop surface facing said space positioned at a selected axial position in said bore to which the length of said neck is to be limited, wherein said top is connected to said die body through axially adjustable mechanism which permits shifting of said stop surface to multiple selected axial positions within said bore.

7. A die for sizing an ammunition case wherein the case has an elongate case body, a neck at one end of the case body for receiving a bullet and a closed head at the opposite end of the case body, the die comprising an elongate die body having an axial bore for receiving the neck of such case coaxially therein, said bore having an inner wall defining a cross-sectional internal configuration substantially conforming to the desired external configuration to which the neck of the case is to be sized, a mandrel mounted in the bore having an outer surface with a diameter less than the diameter of said bore and substantially equal to the desired internal diameter to which the neck is to be sized to define a neck-receiving space between the mandrel and wall, and a stop adjacent said mandrel and projecting outwardly beyond the outer diameter of said mandrel toward said wall, said stop having a stop surface facing said space positioned at a selected axial position in said bore to which the length of said neck is to be limited, wherein said stop is mounted on a screw-adjustable element connected to said die body operable to permit shifting of said stop surface to multiple selected axial positions within said bore.

8. The die of claim 7, wherein said screw-adjustable element comprises an elongate threaded rod extending axially into said bore and said die further comprises an internally threaded connector secured to said body in which said rod is adjustably received.

9. A die for sizing an ammunition case wherein the case has an elongate case body, a neck at one end of the case body for receiving a bullet and a closed head at the opposite end of the case body, the die comprising an elongate die body having an axial bore for receiving the neck of such case coaxially therein, said bore having an inner wall defining a cross-sectional internal configuration substantially conforming to the desired external configuration to which the neck of the case is to be sized, a mandrel mounted in the bore having an outer surface with a diameter less than the diameter of said bore and substantially equal to the desired internal diameter to which the neck is to be sized to define a neck-receiving space between the mandrel and wall, and a stop adjacent said mandrel and projecting outwardly beyond the outer diameter of said mandrel toward said wall, said stop having a stop surface facing said space positioned at a selected axial position in said bore to which the length of said neck is to be limited, which further comprises an externally threaded rod connected to said die body and extending axially into said bore, and said stop has an internal threaded bore which is screwed onto said rod to permit shifting of said element to multiple selected axial positions in said bore.

10. The die of claim 9, wherein said mandrel and stop are secured to each other to move concurrently in said bore.

11. The die of claim 9, which further comprises a jam nut screwed onto said rod adjacent said stop operable to press against said stop to impede movement thereof from a selected axial position on said rod.

12. A die for sizing an ammunition case wherein the case has an elongate case body, a neck at one end of the case body for receiving a bullet and a closed head at the opposite end of the case body, the die comprising an elongate die body having an axial bore for receiving the neck of such case coaxially therein, said bore having an inner wall defining a cross-sectional internal configuration substantially conforming to the desired external configuration to which the neck of the case is to be sized, an elongate threaded rod connected to said die body and extending coaxially into said bore, and a combination mandrel and stop element having an internally threaded bore extending axially therethrough, said element comprising a mandrel portion having an outer surface with a diameter less than the diameter of said bore and substantially equal to the desired internal diameter to which the neck is to be sized to define a neck-receiving space between said mandrel and wall, and a stop portion adjacent said mandrel portion projecting outwardly beyond the outer diameter of said mandrel portion toward said wall, said stop portion having a stop surface facing said space, said mandrel-stop element being adjustable axially on said rod to permit shifting to selected axial positions in said bore to place the stop surface in a position to which the length of said neck is to be limited.

13. The die of claim 12, wherein said stop surface forms a ring which projects outwardly beyond said mandrel portion outer surface at an angle greater than 90 degrees.

14. The die of claim 13, wherein said angle is in a range of from 120 to 170 degrees.

15. The die of claim 13, wherein said angle is in a range of from 130 to 160 degrees.

16. The die of claim 13, which further comprises a jam nut screwed onto said rod adjacent said element operable to press against said element to impede movement thereof from a selected axial position on said rod.

17. A die for sizing an ammunition case wherein the case has an elongate case body, a neck at one end of the case body for receiving a bullet and a closed head at the opposite end of the case body, the die comprising an elongate die body having an axial bore for receiving the neck of such case coaxially therein, said bore having a neck region with a wall having an inner configuration substantially conforming to the desired external configuration to which the neck of the case is to be sized, a mandrel mounted in said neck region of the bore having an outer surface with a diameter less than the diameter of said neck region and substantially equal to the desired internal diameter to which the neck is to be sized to define a neck-receiving space between said mandrel and wall, a stop mounted adjacent said mandrel and projecting outwardly beyond the outer diameter of said mandrel toward said wall, said stop having a stop surface facing said space and positioned at a selected axial position in said bore to which the length of said neck is to be limited, said stop surface projecting outwardly beyond and disposed at an angle greater than 90 degrees relative to the outer surface of the mandrel, and axially adjustable mechanism interconnecting said stop and said die body permitting shifting of said stop surface to multiple selected axial positions within said bore.

18. The die of claim 17, wherein said mandrel and stop are secured to each other to move concurrently in said bore.

19. A combination mandrel and stop member adapted for use with an ammunition case sizing die having a die body with a neck region having an inner wall of a defined cross-sectional configuration to which the outer surface of the neck of an ammunition case is to be sized and a threaded decapping rod extending axially therethrough, said mandrel and stop member comprising a mandrel portion having a cylindrical outer surface with a first diameter which is less than the internal diameter of the neck region of the die and substantially equal to the desired internal diameter to which the neck is to be sized, and a stop portion having a second diameter greater than said first diameter and forming a stop surface projecting radially outwardly from said mandrel portion and disposed at an angle in a range of from 35 to 55 degrees relative to the longitudinal axis of the member.

20. The combination of claim 19, wherein the angle is about 45 degrees.

21. The combination of claim 19, wherein said second diameter mates closely with the inner wall of the neck region of the die body and said stop portion provides an angled chamfer to form a chamfer inside the mouth of the neck of an ammunition case and restrict elongation of the neck during the resizing process.

22. The combination of claim 21, wherein said mandrel and stop member is mounted on said decapping rod for axial movement to multiple selected positions within said die.

23. The combination of claim 22, wherein said mandrel and stop member has an internally threaded bore extending therethrough which is screwed onto said decapping rod and is shiftable relative thereto upon relative rotation between the decapping rod and member.

24. The combination of claim 23, which further comprises a jam nut screwed onto the rod adjacent the combination mandrel and stop member operable to press thereagainst to impede movement from a selected axial position on the rod.

* * * * *